US005138736A

United States Patent [19]

Pesa

[11] Patent Number: 5,138,736

[45] Date of Patent: Aug. 18, 1992

[54] BUTTERFLY MOP

[75] Inventor: William A. Pesa, Wooster, Ohio

[73] Assignee: Rubbermaid Incorporated, Wooster, Ohio

[21] Appl. No.: 738,836

[22] Filed: Aug. 1, 1991

[51] Int. Cl.[5] ..... A47L 13/146

[52] U.S. Cl. ..... 15/119.2; 15/244.1

[58] Field of Search ..... 15/119 A, 119 R, 244.1

[56] References Cited

U.S. PATENT DOCUMENTS

| | | | |
|---|---|---|---|
| 1,912,543 | 6/1933 | Sendler | 15/119 |
| 2,643,407 | 6/1953 | Vosbikian et al. | 15/119 A |
| 2,646,587 | 7/1953 | Sjöblom | 15/119 |
| 2,651,069 | 9/1953 | Hoffman | 15/119 |
| 2,898,617 | 8/1959 | Dunbar | 15/119 |
| 3,031,706 | 5/1962 | Daline | 15/119 |
| 3,166,774 | 1/1965 | Blum | 15/119 |
| 4,044,419 | 8/1977 | Robinson | 15/119 A |
| 4,438,540 | 3/1984 | Senour | 15/119 |
| 4,468,830 | 9/1984 | Batchelor | 15/119 A |
| 4,604,767 | 8/1986 | Burkhart et al. | 15/119 |
| 4,831,677 | 5/1989 | Morrison et al. | 15/119 A |

OTHER PUBLICATIONS

Royal Maid Automatic Sponge Mops & Refills, 2 page advertisement; Royal Maid Association for the Blind, Inc., P.O. Drawer 30, Hansen Road, Hazlehurst, Miss. 39083; 1990.

Royal Maid "Angle Matic", 1 page advertisement, The Lighthouse for the Blind, Inc., P.O. Box C-14119, Seattle, Wash. 98114; 1990.

Kellogg, 2 page advertisement, Kellogg Brush Mfg. Co., Easthampton, Mass. 01027; 1990.

2 pages advertisement, Empire Brushes, Inc., U.S. Highway 13, North Greenville, N.C. 27835; 1991.

2 page advertisement, Suburbanite Industries, Hopping Brook Industrial Park, P.O. Box 1000, Holliston, Mass. 01746; 1990.

Libman, 3 page advertisement; The Libman Company, P.O. Box 68, 220 N. Sheldon, Arcola, Ill. 61910; 1989.

Easy Wring, 2 page advertisement, The Drackett Products Company, 5020 Spring Grove Avenue, Cincinnati, Ohio 45323; 1990.

3 page advertisement, Quickie Manufacturing Corp., P.O. Box 156, Cinnaminson, N.J. 08077; 1990.

2 page advertisement, Vining Industries, 2530 Columbus Avenue, P.O. Box 1606, Springfield, Ohio 45501; 1990.

*Primary Examiner*—Chris K. Moore

*Attorney, Agent, or Firm*—Renner, Kenner, Greive, Bobak, Taylor & Weber

[57] ABSTRACT

A mop (10) includes a handle (11), a grip handle (12) slidably received on the handle (11), a linkage and squeeze wire assembly (13), a mounting and operating assembly (14) and a mop pad (15) carried thereby. The mounting and operating assembly (14) includes a shroud (31) carrying the handle (11) and pivotally carrying a squeeze wire (24). The shroud (31) also pivotally carries a pair of paddles (33) which carry the mop pad (15) and which are provided with wear pads (58) attached thereto. Movement of the grip handle (12) along the handle (11) causes the squeeze wire (24) to pivot via linkage (22). The squeeze wire (24) engages the wear pads (58) to pivot the paddles (33) to fold and thereby squeeze the mop pad (15).

23 Claims, 5 Drawing Sheets

16
17
12
18
19
20
23
11
36
31
21
37
35
22
30
25
14
32
42
41
13
42
42
44
43
42
43
44
24
33
47
53
58
29
27
52
49
50
26
51
28
48
55
46
34
50
46
58
33
54
53
15
50
49
47
51
52

BUTTERFLY MOP

TECHNICAL FIELD

This invention relates to a mop. More particularly, this invention relates to the type of mop known as a butterfly mop which is actuated to pivot a replaceable sponge cleaning insert pad to evacuate water therefrom.

BACKGROUND ART

Mops identified in the industry as butterfly mops are known in the art. Such mops have typically been constructed primarily of a metallic material and are thus costly to manufacture, to assemble and to provide replacement parts. These mops include a handle which must be crimped to a shroud which carries paddles that hold a sponge cleaning pad. A grip handle is slidably received on the mop handle and through a linkage is connected to a squeeze wire. Sliding of the grip handle relative to the mop handle causes the squeeze wire to bear against the metallic paddles to pivot the same and fold the sponge insert pad squeezing it against itself.

In addition to being costly to manufacture and assemble, such mops are often unreliably operable and/or difficult to operate. The metal-to-metal contact between the squeeze wire and the paddles often renders it difficult to initiate the squeezing of the mop pad particularly after the mop has aged and been exposed to water which will tend to mar and pit the surfaces impeding the required facile sliding movement. Attempts to alleviate these problems have focused on providing a roller-like engagement between the squeeze wire and the paddles. However, again particularly after repeated use, the rollers will tend to bind, thereby skidding instead of rolling, causing unreliable and difficult operation.

DISCLOSURE OF THE INVENTION

It is thus a primary object of the present invention to provide a butterfly mop which is easy to activate to squeeze its sponge insert pad.

It is another object of the present invention to provide a butterfly mop, as above, which is reliable, operating every time to squeeze the sponge insert pad.

It is a further object of the present invention to provide a butterfly mop, as above, which is economically manufactured and assembled.

It is an additional object of the present invention to provide a butterfly mop, as above, in which the majority of the components are made of a plastic material and in which there is no metal-to-metal contact during the activation thereof.

These and other objects of the present invention, as well as the advantages thereof over existing prior art forms, which will become apparent from the description to follow, are accomplished by the means hereinafter described and claimed.

In general, a mop according to the concepts of the present invention includes a mop handle carried by a shroud. A squeeze wire is pivotally carried by the shroud and is attached, by a linkage mechanism, to a grip handle which is slidably received on the mop handle. A pair of squeeze paddles carry a mop pad and are pivotally carried by the shroud. Each paddle is provided with a wear pad which is engaged by the squeeze wire upon movement of the grip handle along the mop handle to pivot the paddles toward each other to squeeze the mop pad.

A preferred exemplary butterfly mop incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
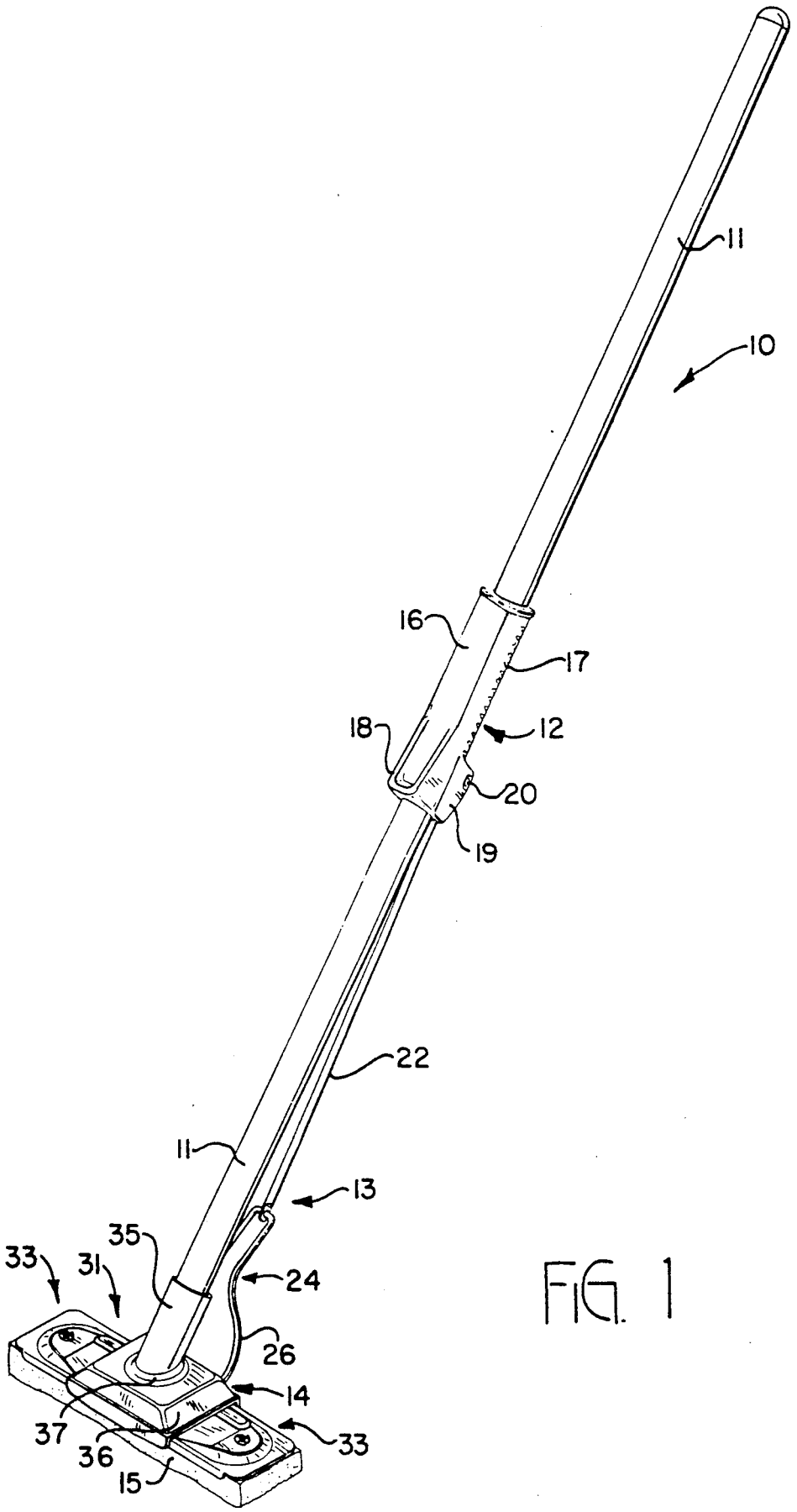
FIG. 1 is a perspective view of a butterfly mop incorporating the concepts of the present invention.

A butterfly mop made in accordance with the concepts of the present invention is indicated generally by the numeral 10 in FIG. 1. With minor exceptions, to be hereinafter described, mop 10 is made entirely out of plastic and includes a handle 11, a slide grip handle indicated generally by the numeral 12, a metallic linkage and squeeze wire assembly indicated generally by the numeral 13, a mounting and operating assembly indicated generally by the numeral 14, and a replaceable sponge mop pad 15.

Figure 2:
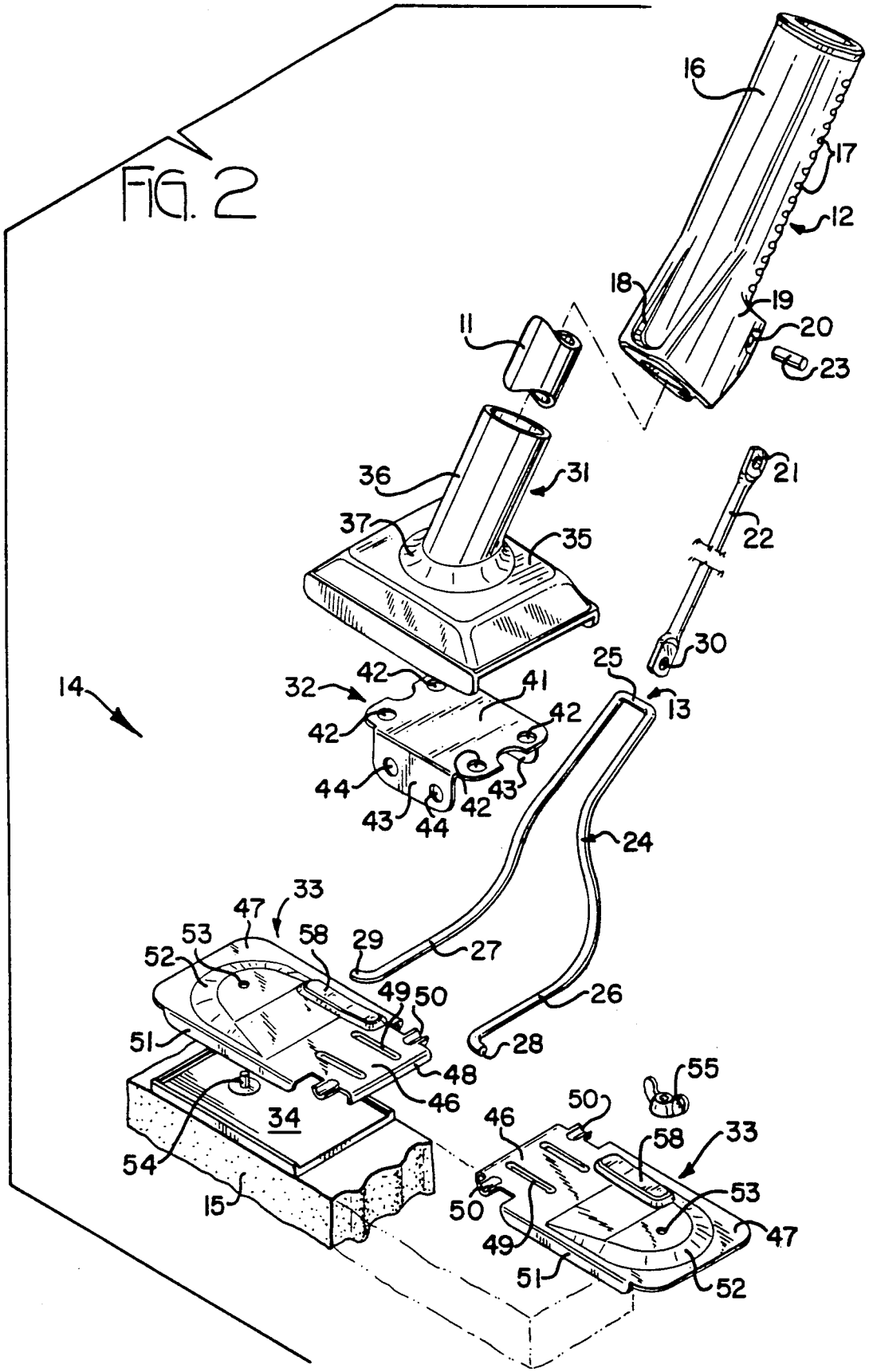
FIG. 2 is an enlarged, fragmented, exploded perspective view showing the major components of the butterfly mop of FIG. 1.

As best shown in FIG. 2, slide grip handle 12 includes a cylindrical body portion 16 adapted to be slidably received on mop handle 11. A portion of the outer periphery of body portion 16 may be provided with serrations 17 for ease in gripping handle 12. The lower portion of slide handle body 16 may also be provided with a thumb slot 18 to assist the user in moving handle 12 downwardly along mop handle 11. The lower portion of slide handle body 16 is also provided with a linkage engaging slot housing 19 having an aperture 20 extending laterally therethrough. Housing 19 receives the upper flat end 21 of an elongate metallic link rod 22 which is part of linkage and squeeze wire assembly 13. A pin 23 positioned through aperture 20 and flat end 21 attaches gripping handle 12 to rod 22.

Linkage and squeeze wire assembly 13 also includes a metallic squeeze wire generally indicated by the numeral 24. Squeeze wire 24 is a continuous member having an upper grip end 25 and two curved squeeze arms 26, 27. The ends of squeeze arms 26 and 27 turn outwardly, as at 28 and 29, respectively, to form pivot points for squeeze wire 24 as will be hereinafter described. The lower end of link rod 22 is provided with an aperture 30 which is threaded onto, and slidably received by, squeeze wire 24 to engage the grip end 25 thereof as shown in FIG. 1.

Mounting and operating assembly 14, as shown in FIG. 2, includes as its primary components a shroud indicated generally by the numeral 31, a paddle pivot bracket indicated generally by the numeral 32, a pair of metallic paddles each indicated generally by the numeral 33, and a pair of sponge backing plates 34.

Figure 4:
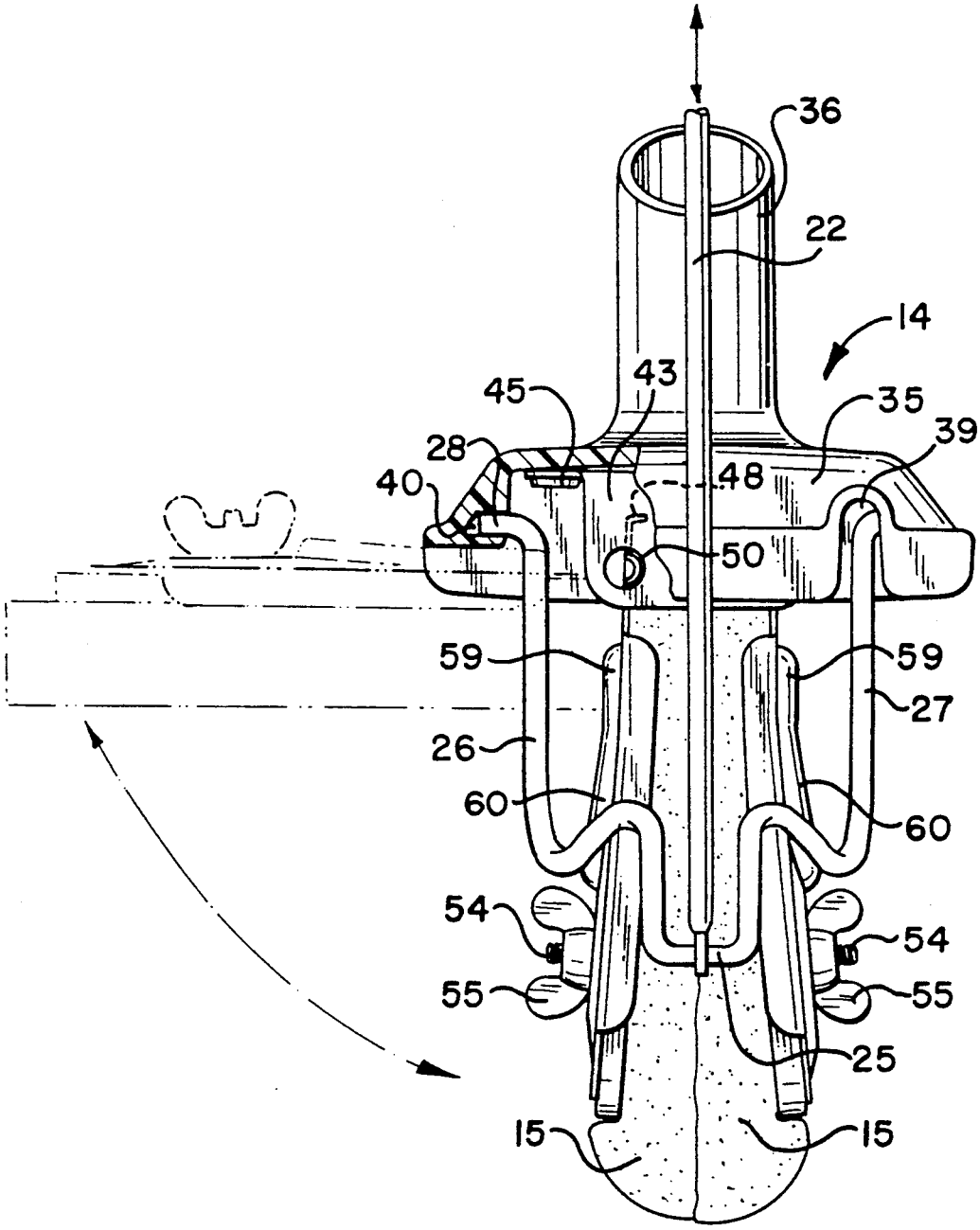
FIG. 4 is an enlarged, fragmented and partially sectioned rear view showing the butterfly mop of FIG. 1 in a squeezed position.
Figure 5:
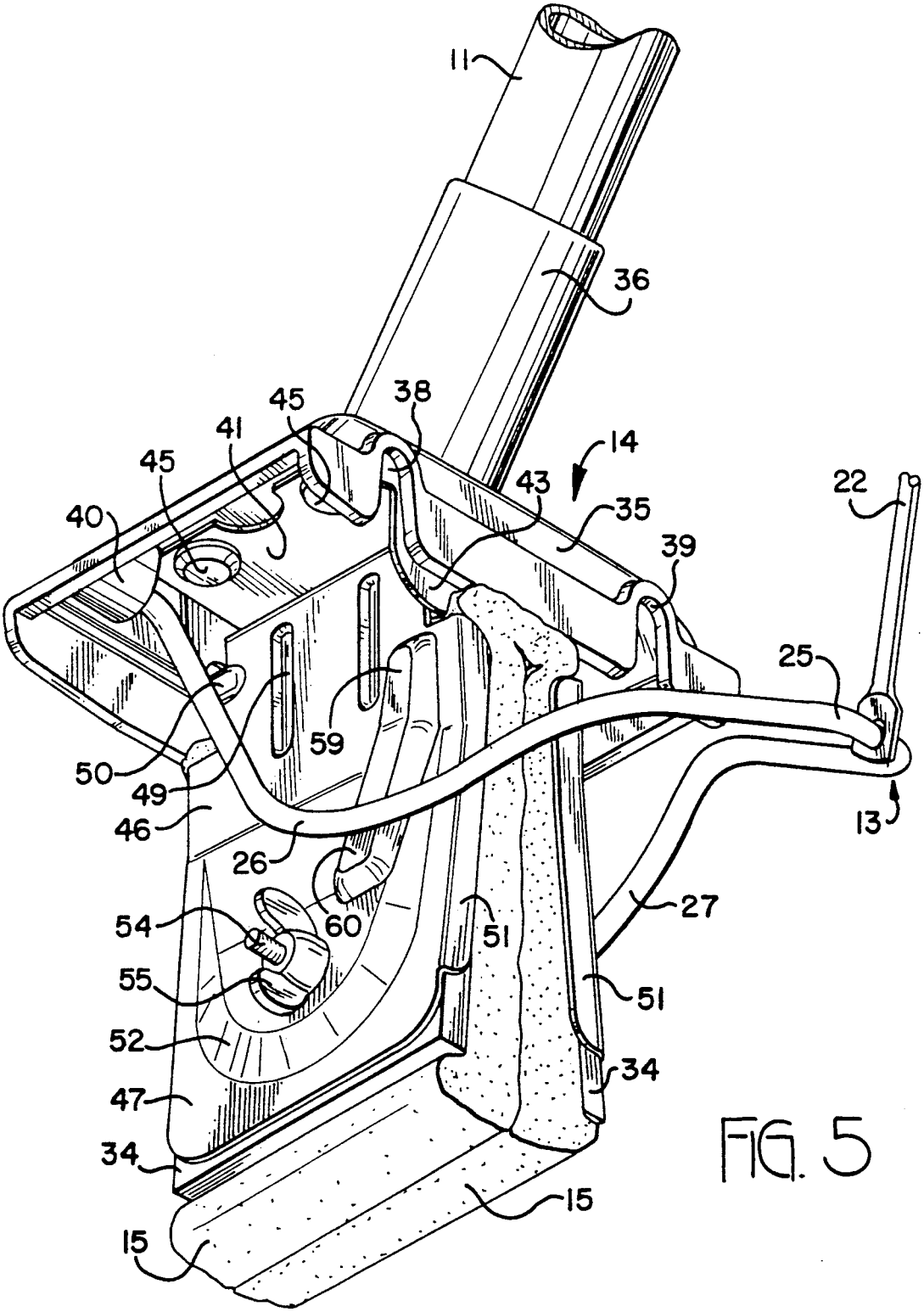
FIG. 5 is an enlarged, fragmented, perspective view showing the butterfly mop of FIG. 1 in a squeezed position.

Shroud 31 includes a body portion 35 and a handle socket 36 integrally molded therewith which extends upwardly at an angle from body portion 35 to receive the bottom of mop handle 11. A stiffening collar 37 is molded into the junction of body portion 35 and socket 36. As shown in FIGS. 4 and 5, the back of shroud body portion 35 is slotted, as at 38 and 39, to receive squeeze arms 26 and 27, respectively, therein when they are in the upright, FIG. 1, position. The interior of shroud body portion 35 is provided with sockets 40 (one shown) to receive the turned out ends 28 and 29 of squeeze arms 26 and 27. Thus, to assemble squeeze arms 26 and 27 to shroud 31, one merely squeezes the ends thereof toward each other and upon release, turned out ends 28 and 29 snap into sockets 40. Squeeze arms 26 and 27 thus pivot within, and on an axis defined by, sockets 40.

Paddle pivot bracket 32 includes a flat top surface 41 having four apertures 42 therein and downwardly directed paddle pivot support tabs 43 each having two pivot apertures 44 therein. Bracket 32 is attached to the underside of shroud body portion 35 by thermowelding, as at 5 (FIG. 5), through apertures 42 in top surface 41.

Figure 3:
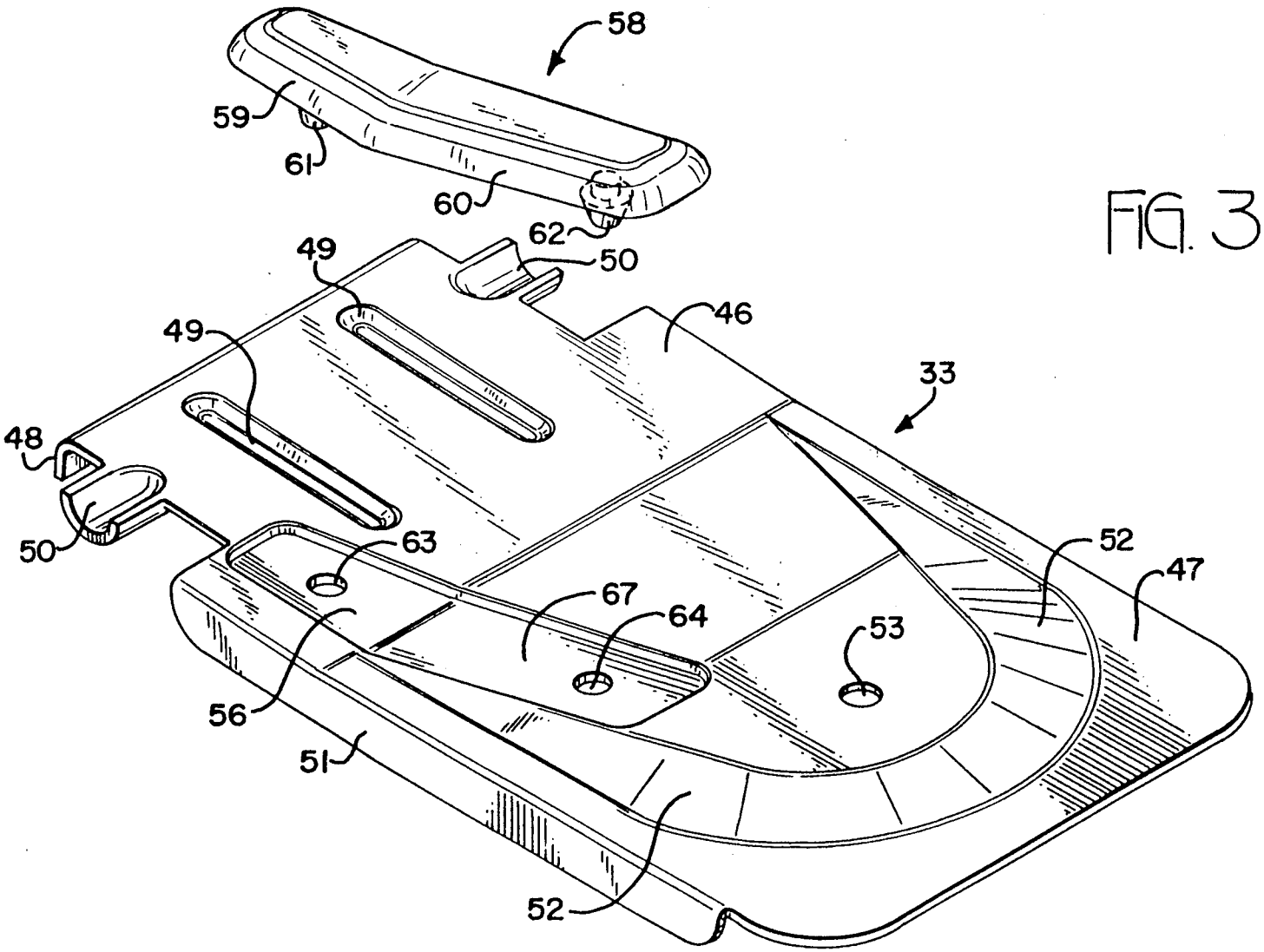
FIG. 3 is an enlarged, exploded, perspective view showing a paddle and wear plate component of the butterfly mop of FIG. 1.

The configuration of each paddle 33 is best shown in FIG. 3. Each paddle 33 includes an inner base portion 46 and an outer squeeze portion 47 extending slightly angularly from base portion 46. Base portion 46 is provided with an inner downturned flange 48 and longitudinally extending strengthening recesses 49 therein. Dowels 50 extend from each side of base portion 46 and while they are shown as being semicircular in nature, they could well be circular dowels without departing from the concepts of this invention. As shown in FIGS. 4 and 5, dowels 50 are received within pivot apertures 44 of tabs 43 of pivot bracket 32 and thus paddles 33 pivot with respect to shroud 31 on an axis defined by dowels 50.

Outer squeeze portion 47 of paddles 33 is provided with downturned flanges 51 at the sides thereof which fit over sponge backing plate 34. A U-shaped stiffening ridge 52 can be formed on the top surface of squeeze portion 47 of paddles 33 and it surrounds the location at which paddles 33 are attached to mop pads 15. To this end, squeeze portion 47 is provided with an aperture 53 (FIG. 2) therethrough, through which is received a threaded shaft 54 extending upwardly from mop pad 15 and through backing plate 34. A wing nut 55 may be utilized to attach each paddle 33 to each pad 15 with a backing plate 34 therebetween.

The inside top surfaces of base portion 46 and squeeze portion 47 of paddles 33, that is, the side of the top surface of each paddle 33 facing the user, are provided with adjoining recesses 56 and 57, respectively. An angled wear pad, generally indicated by the numeral 58, includes a first shorter portion 59 received in recess 56 and a second longer portion 60, angular to portion 59, and received in recess 57. The angle between portions 59 and 60 is provided to increase the efficiency and ease of operation of mop 10, with the ideal angle between the two being approximately 6½. Snap tabs 61 and 62, beneath portions 59 and 60, respectively, are received in apertures 63 and 64, respectively, formed in recesses 56 and 57, respectively. Thus, if desired, wear pad 58 could be replaced after extended use, but such should not be necessary. Wear pad 58 is preferably made of a polypropylene material and provides a smooth, almost friction free, surface on which squeeze wires 26 and 27 ride during operation of mop 10 now to be described.

In operation, with mop 10 in the mopping position shown in FIG. 1, paddles 33 are generally in a horizontal position, as shown in phantom lines in FIG. 4, with squeeze wires 26 and 27 being received in slots 38 and 39 of shroud body 35. A spring (not shown) is sandwiched between the top of each paddle 33 and bracket 32 to assist in maintaining mop 10 in its mopping position. When it is desired to remove water from mop pad 15, grip handle 12 is manually moved down mop handle 11 causing squeeze wires 26 and 27 to rotate within sockets 40 of shroud body 35. This action overcomes the bias of the springs and the squeeze wires 26 and 27 thereby move freely along wear pads 58, first along portion 59 and then along portion 60 thereof to fold mop pad 15 and squeeze water therefrom as shown in FIGS. 4 and 5. Since there is no metal-to-metal contact during this procedure, mop 10 can be reliably and easily drained of its water on each repeated action, as just described.

It should thus be evident that a mop constructed according to the concepts of the present invention, as described herein, accomplishes the objects of the present invention and substantially improves the art.

I claim:

1. A mop comprising a mop handle, a grip handle slidably received on said mop handle, a squeeze wire having squeeze arms, means to link said grip handle to said squeeze wire, a shroud carrying said mop handle, means defining a pivot for said squeeze wire with respect to said shroud, two squeeze paddles, means defining a pivot for said paddles with respect to said shroud, a mop pad carried by said paddles, and a wear pad carried by each said paddle such that upon movement of said grip handle along said mop handle said squeeze arms of said squeeze wire engage said wear pads to pivot said paddles toward each other to squeeze said mop pad.

2. A mop according to claim 1 wherein said wear pad includes a first wear surface and a second wear surface angular to said first wear surface.

3. A mop according to claim 2 wherein said first wear surface is shorter than said second wear surface.

4. A mop according to claim 3 wherein said paddles have a recess therein, and further comprising means to attach said wear pads to said paddles within said recess.

5. A mop according to claim 4 wherein said means to attach includes snap tabs positionable in apertures in said recess.

6. A mop according to claim 1 where said wear pads are constructed of a polypropylene material.

7. A mop according to claim 1 wherein said means defining a pivot for said squeeze wire with respect to said shroud includes socket means formed in said shroud and receiving said squeeze arms.

8. A mop according to claim 7 wherein said means defining a pivot for said squeeze wire with respect to said shroud includes outturned ends formed on said squeeze arms, said outturned ends being received within and being pivotable with respect to said socket means.

9. A mop according to claim 1 wherein said means defining a pivot for said paddles with respect to said shroud includes bracket means carried by said shroud, and means on said paddles pivotally received by said bracket means.

10. A mop according to claim 9 further comprising means to attach said bracket means to said shroud.

11. A mop according to claim 9 wherein said means on said paddles include dowel members extending outwardly therefrom, said bracket means having apertures receiving said dowel members.

12. A mop according to claim 1 further comprising a pad backing plate between said mop pad and each of said paddles, and means to attach said mop pad to said paddles with said backing plate therebetween.

13. A mop according to claim 12 wherein said means to attach includes a threaded shaft extending from said mop pad and through said backing plate and said paddles, and a wing nut attached to said shaft.

14. A mop according to claim 1 wherein said shroud includes means receiving said mop handle.

15. A mop according to claim 1 wherein said shroud includes slots receiving a portion of said squeeze wire.

16. A mop according to claim 1 wherein said means to link includes a rod member having one end attached to said grip handle and its other end received by said squeeze wire.

17. A mop according to claim 1 wherein said grip handle includes a generally cylindrical body member, a thumb receiving slot formed on said body member, and means to engage said means to link formed on said body member.

18. A squeeze mop actuating assembly comprising a shroud, paddles pivotally mounted on said shroud, a mop pad carried by said paddles, a squeeze wire pivotally mounted on said shroud, a wear pad attached to each paddle, and means to pivot said squeeze wire so that said squeeze wire engages said wear pads to pivot said paddles to squeeze said mop pad.

19. A squeeze mop actuating assembly according to claim 18 wherein said wear pad includes a first wear surface and a second wear surface angular to said first wear surface.

20. A squeeze mop actuating assembly according to claim 19 wherein said first wear surface is shorter than said second wear surface.

21. A squeeze mop actuating assembly according to claim 20 wherein said paddles have a recess therein, and further comprising means to attach said wear pads to said paddles within said recess.

22. A squeeze mop actuating assembly according to claim 18 where said wear pads are constructed of a polypropylene material.

23. A squeeze mop actuating assembly according to claim 18 further comprising a mop handle carried by said shroud, said means to pivot including a grip handle slidably received on said mop handle, and means to link said grip handle to said squeeze wire.

* * * * *